US006024622A

United States Patent [19]

Ohoshi

[11] Patent Number: 6,024,622

[45] Date of Patent: Feb. 15, 2000

[54] FIELD EMISSION TYPE EMITTER

[75] Inventor: Toshio Ohoshi, Tokyo, Japan

[73] Assignee: Sony Corporation, Tokyo, Japan

[21] Appl. No.: 09/045,949

[22] Filed: Mar. 23, 1998

[30] Foreign Application Priority Data

Mar. 24, 1997 [JP] Japan ..... 9-069481

[51] Int. Cl.[7] ..... H01J 9/04

[52] U.S. Cl. ..... 445/51

[58] Field of Search ..... 445/24, 25, 51

[56] References Cited

U.S. PATENT DOCUMENTS 5,462,467 10/1995 Macaulay et al. ..... 445/50

*Primary Examiner*—Kenneth J. Ramsey
*Attorney, Agent, or Firm*—Hill & Simpson

[57] ABSTRACT

A method for manufacturing a field emission type emitter including a cathode electrode formed on a substrate, an insulating film formed on the cathode electrode, a cavity formed in the insulating film, a cathode formed on the cathode electrode inside the cavity, and a gate electrode formed on the insulating film, comprising the step of electrochemically making the cathode in an electrolyte containing of a salt of a metal. The metal is typically the same as the metal forming the cathode electrode.

11 Claims, 12 Drawing Sheets

FIELD EMISSION TYPE EMITTER

BACKGROUND OF THE INVENTION

1. Field of the Invention

This invention relates to a method for fabricating a field emission type emitter suitable for use in, for example, fabrication of a flat display using a field emission type emitter.

2. Description of the Related Art

Conventional flat displays using a Spindt type field emission type emitter are constructed, for example, as shown in FIGS. 1 and 2. That is, a plurality of parallel strip-shaped cathode electrodes 102 and a plurality of parallel strip-shaped gate electrodes 103 are provided on a rear glass panel 101 in a crossing relation via an insulating film 104. The gate electrodes 103 have formed tens to thousands holes 103*a* at each location overlapping the cathode electrodes 102. The insulating film 104 has cavities 104*a* at portions underlying the holes 103*a* to expose the cathode electrodes 102, and the cathode electrodes 102 have formed conical cathodes 105 for emitting electrons in locations exposed into the cavities 104*a* of the insulating film 104. On the other hand, a front glass panel 106 is provided in confrontation with the rear glass panel 101. the front glass panel 106 has formed, on its surface facing to the rear glass panel 101, fluorescent panels 107 which are sized and shaped identically to the electron lead-out electrodes, namely, the gate electrodes 103.

The principle of operations of the flat display is explained below. An electric field intensive enough to emit a tunneling current is applied between the gate electrodes 103 and the cathode electrodes 105 so that electrons be emitted from the cathode 105 and hit the fluorescent panels 107 on the front glass panel 106 to produce cathode luminescence.

The field emission type emitter having a great role in a flat display is manufactured in a process explained below.

First, as shown in FIG. 3, a chrome (Cr) film 108 of a thickness from one hundred to hundreds of nm is formed on the rear glass panel 101. Next, as shown in FIG. 4, the Cr film 108 is patterned into strips by photolithography and etching to form cathode electrodes 102. Next, as shown in FIG. 5, an insulating film 104 made of $SiO_2$ to a thickness of hundreds of nm to some $\mu$m is formed to cover the cathode electrodes 102 and to smooth the surface. After that, molybdenum (Mo), tungsten (W), niobium (Nb), or the like, is stacked to a thickness of one hundred to hundreds of nm on the insulating film 104 to form a metal film, and the metal film is patterned by photolithography and etching into the form of strips to form the gate electrodes 103 crossing the cathode electrodes 102 as shown in FIG. 6. Next, as shown in FIG. 7, photolithography is done to form on the gate electrodes 103 and the insulating film 104 a resist pattern 109 having apertures 109*a* at crossing points in intervals of tens of $\mu$m to some $\mu$m. FIG. 7 is an enlarged cross-sectional view of the part for the cathode, and so are also FIGS. 8 and 12. Next, as shown in FIG. 8, using a resist pattern 109 as a mask, the gate electrodes 103 are etched to make holes 103*a*.

Next, as shown in FIG. 9, using the resist pattern 109 and the gate electrode 103 as a mask, the insulating film 104 is etched by wet etching to make cavities 104*a*. After that, the resist pattern is removed.

Next, as shown in FIG. 10, aluminum (Al), or other metal, readily detached or solved in a later step, is stacked by vapor deposition from a direction aslant of the surface of the rear glass panel 101. After that, Mo or other metal is vapor-deposited from a direction normal to the rear glass panel 101. When the metal is stacked to a certain thickness, the metal film 111 stacked on the separation layer 110 extends continuous over the cavities 104*a* as shown in FIG. 11, and an appropriately sized conical cathode 105 is formed on each cathode electrode 102 in the cavity 104*a*.

After that, as shown in FIG. 12, the separation layer 110 is removed together with the overlying metal film 111 by etching to complete the intended field emission type emitter.

The above-explained conventional method for emitting a field emission type emitter has the merit of self-forming function in which the shape of the cathode 105 is determined approximately by the ratio between the diameter and the depth of the hole 103*a*, namely, the aspect ratio.

However, it is difficult to stack Mo or other metal with a uniform thickness in the vertical direction on the cathode electrodes 102 within the cavities 104*a*. Therefore, if field emission type emitters made in the above-explained process are used to make a display of a practically acceptable screen size, they inevitably invite significant deterioration of the quality of images of the display.

A solution would be the use of a film-making apparatus promising a uniform vertical thickness of Mo or other metal. However, such a film-making apparatus needs enormous investment, and nevertheless involves practically unacceptable drawbacks, such as useless consumption of most part of an expensive metal, such as Mo, because the metal once stacked on the separation layer 110 must be removed upon making the cathode 105.

OBJECTS AND SUMMARY OF THE INVENTION

It is therefore an object of the invention to provide a method for manufacturing a field emission type emitter, which can make cathodes on cathode electrodes on a large-scaled substrate with a uniform thickness, using a minimum amount of metals, and can contribute to a reduction of the manufacturing cost of field emission type emitter.

According to the invention, there is provided a method for manufacturing a field emission type emitter including a cathode electrode formed on a substrate, an insulating film formed on the cathode electrode, a cavity formed in the insulating film, a cathode formed on the cathode electrode inside the cavity, and a gate electrode formed on the insulating film, comprising the step of:

electrochemically making the cathode in an electrolyte containing of a salt of a metal.

To improve the adhesivity of the cathode to the cathode electrode and the mechanical strength of the cathode, the metal forming the cathode is preferably the same as the metal of the cathode electrode, such as, Ni, Cr, Mo or W.

To improve the thermal, secular stability of the cathode, the electrolyte preferably contains a salt of a cathode-making metal, such as, in particular, Ni or Cr having a high electric conductivity, and an additional salt of a metal, such as Mo or W, having a high melting point, so as to form the cathode by making an alloy or eutectic crystal of the cathode-making metal and the high-melting metal.

To improve the electron emitting characteristic of the cathode, the electrolyte preferably contains a salt of a cathode-making metal and an additional salt of alkaline earth metals, such as ballium (Ba) or magnesium (Mg), having a smaller work function than the cathode-making metal, so as to form the cathode by making an alloy of the cathode-making metal and the alkaline earth metals.

Electrostatically charged organic or inorganic fine particles may be distributed, for example, in the electrolyte so that the fine particles are incorporated into the deposited metal upon making the cathode. The fine particles may be, for example, an oxide of an alkaline earth metals such as Ba or Mg, a carbide of hafnium (Hf), molybdenum (Mo), niobium (Nb), tantalum (Ta), titanium (Ti), tungsten (W) or zirconium (Zr), or lanthanum hexaboride ($LaB_6$). The fine particles are heat-decomposable or soluble to an organic solvent so that pores are made in the cathode by heating the substrate or immersing it into the organic solvent after deposition of the metal and the fine particles. Alternatively, the fine particles may be a low-heat-decomposable or sublimate inorganic compound.

According to the invention configured to make the cathode in an electrochemical process in an electrolyte containing a metal salt, cathodes can be made in a uniform thickness using a minimum amount of a metal in any desired portions on cathode electrodes on a large-scale substrate, and the manufacturing cost of the field emission type emitter can be reduced.

The above, and other, objects, features and advantage of the present invention will become readily apparent from the following detailed description thereof which is to be read in connection with the accompanying drawings.

DETAILED DESCRIPTION OF THE PREFERRED EMBODIMENTS

Some embodiments of the invention are described below with reference to the drawings. In all drawings illustrating embodiments of the invention, the same or equivalent elements are labelled with common numerals.

First explained is a method for manufacturing a field emission type emitter according to the first embodiment of the invention.

Figure 1:
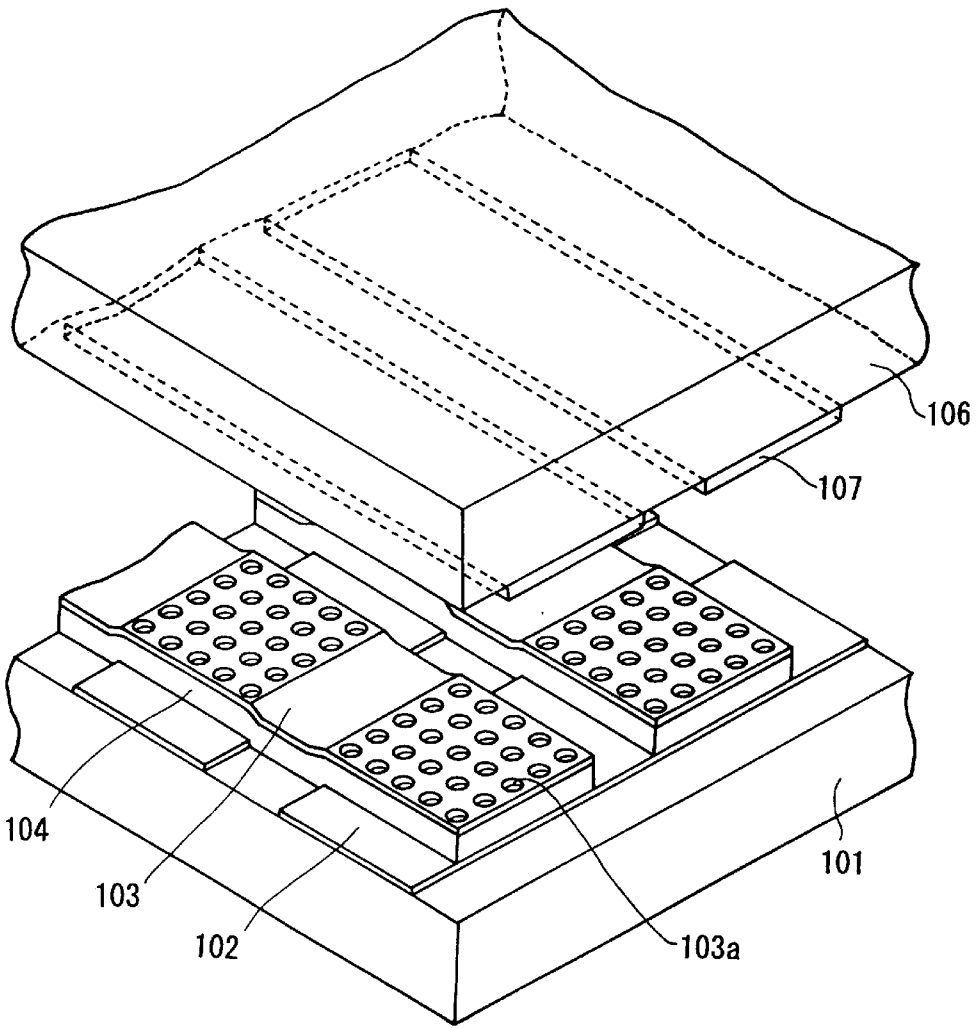
FIG. 1 is a perspective view of a conventional flat display.
Figure 2:
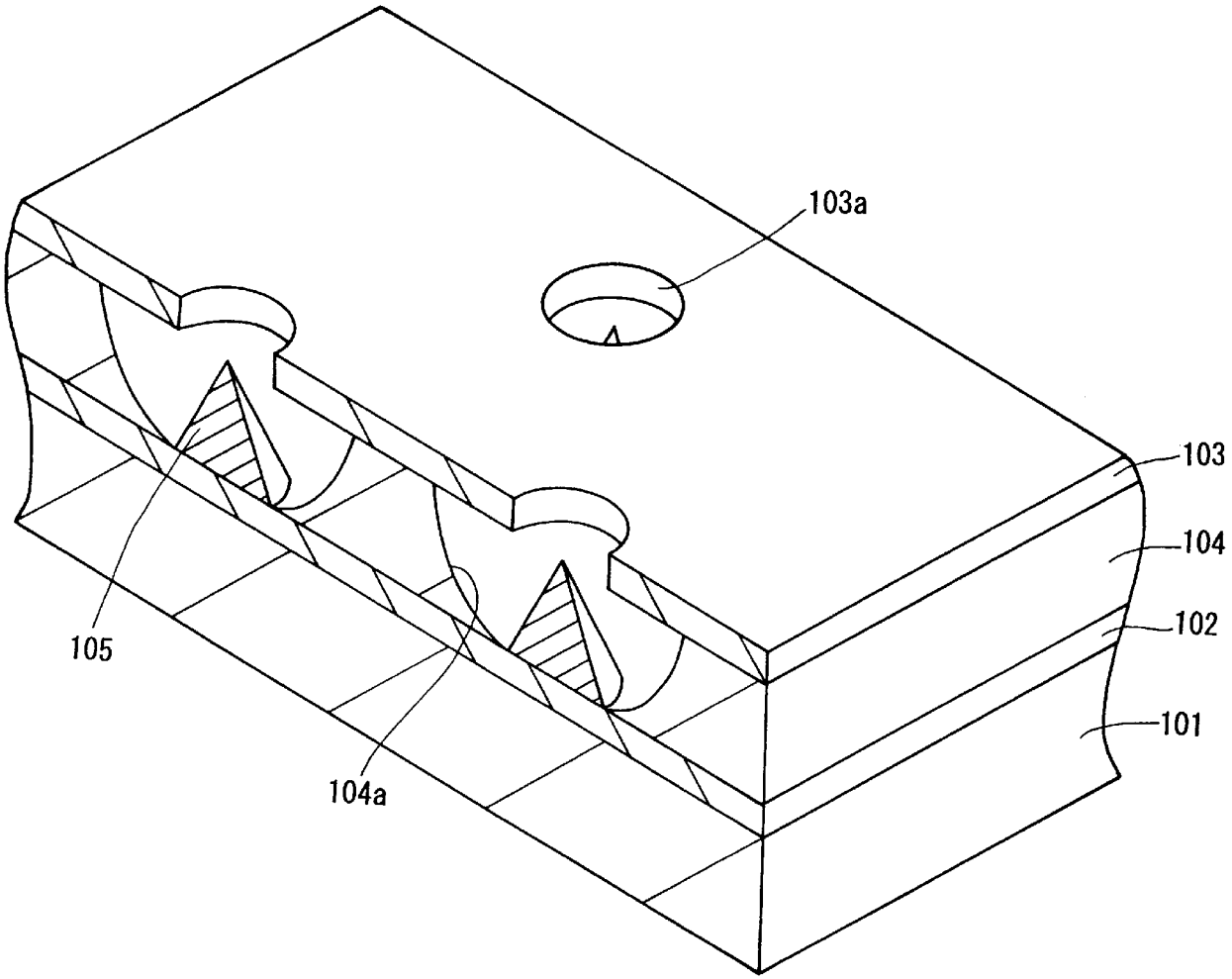
FIG. 2 is a fragmentary, enlarged, cross-sectional view of the conventional flat display.
Figure 3:
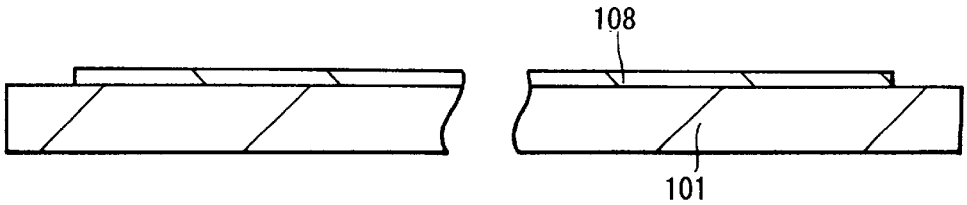
FIG. 3 is a cross-sectional view for explaining a conventional manufacturing method of a field emission type emitter.
Figure 4:
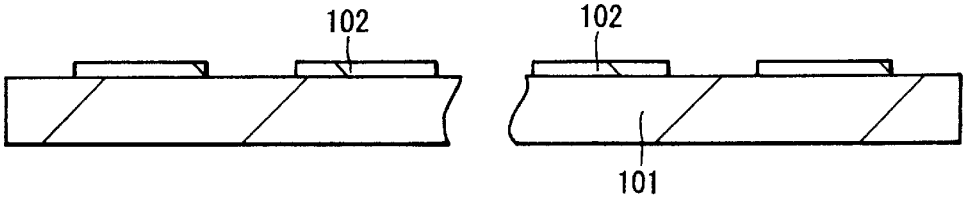
FIG. 4 is a cross-sectional view for explaining the conventional manufacturing method of a field emission type emitter.
Figure 5:
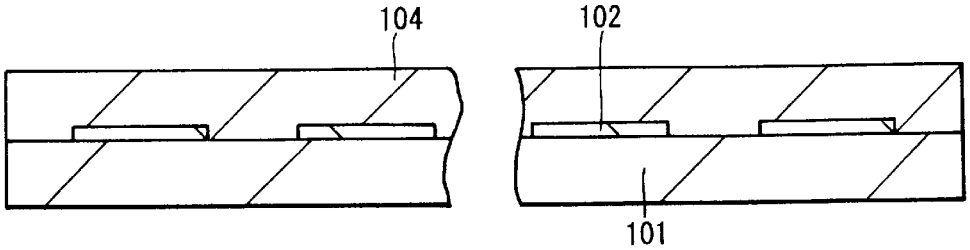
FIG. 5 is a cross-sectional view for explaining the conventional manufacturing method of a field emission type emitter.
Figure 6:
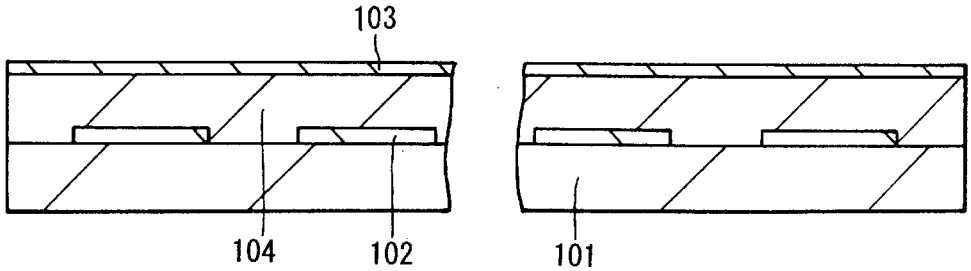
FIG. 6 is a cross-sectional view for explaining the conventional manufacturing method of a field emission type emitter.
Figure 7:
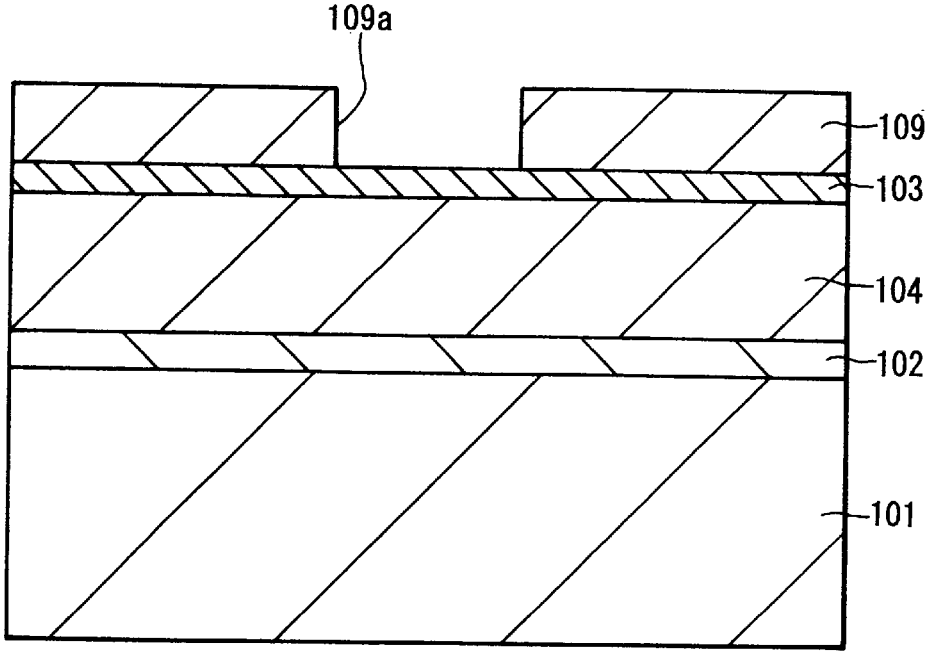
FIG. 7 is a cross-sectional view for explaining the conventional manufacturing method of a field emission type emitter.
Figure 8:
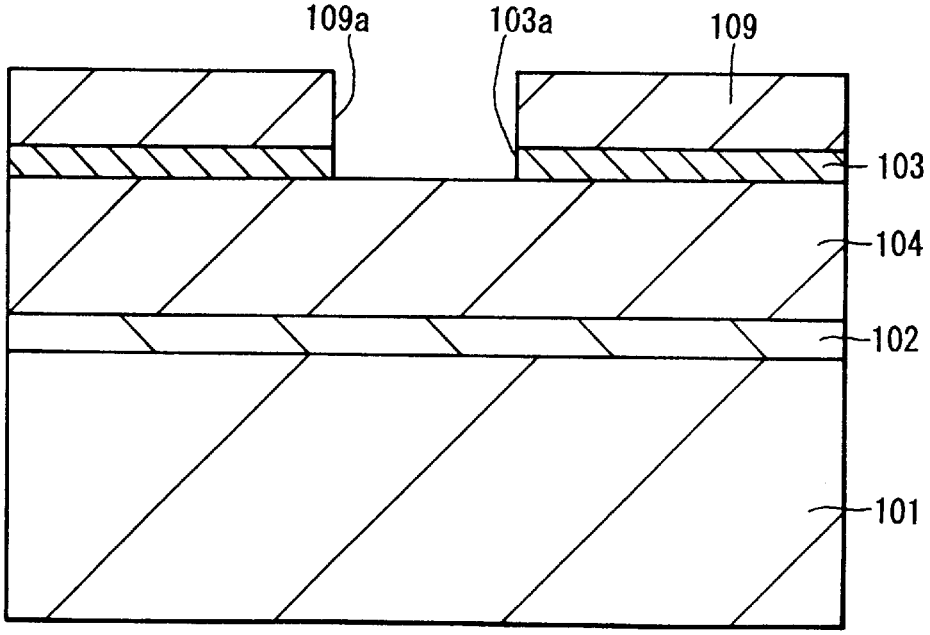
FIG. 8 is a cross-sectional view for explaining the conventional manufacturing method of a field emission type emitter.
Figure 9:
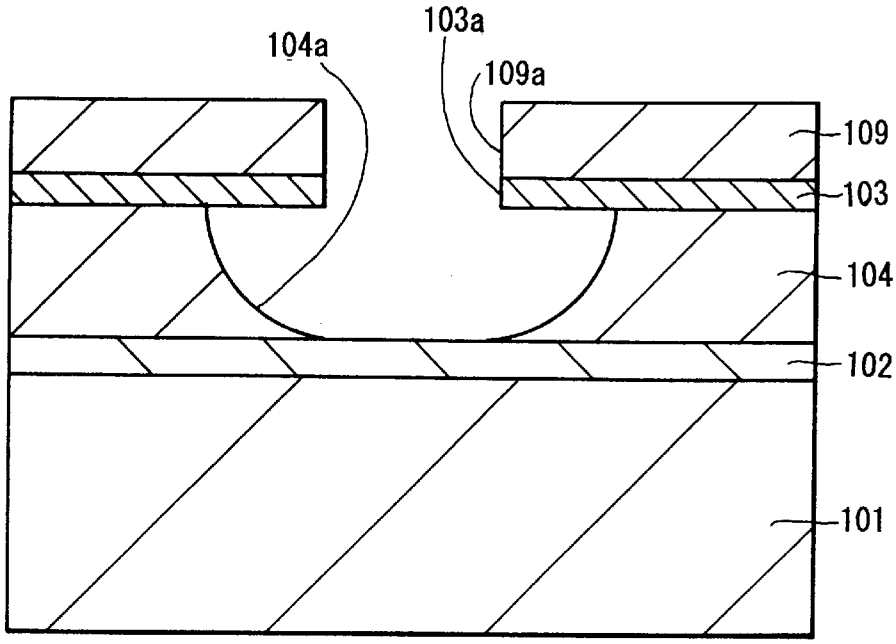
FIG. 9 is a cross-sectional-view for explaining the conventional manufacturing method of a field emission type emitter.
Figure 10:
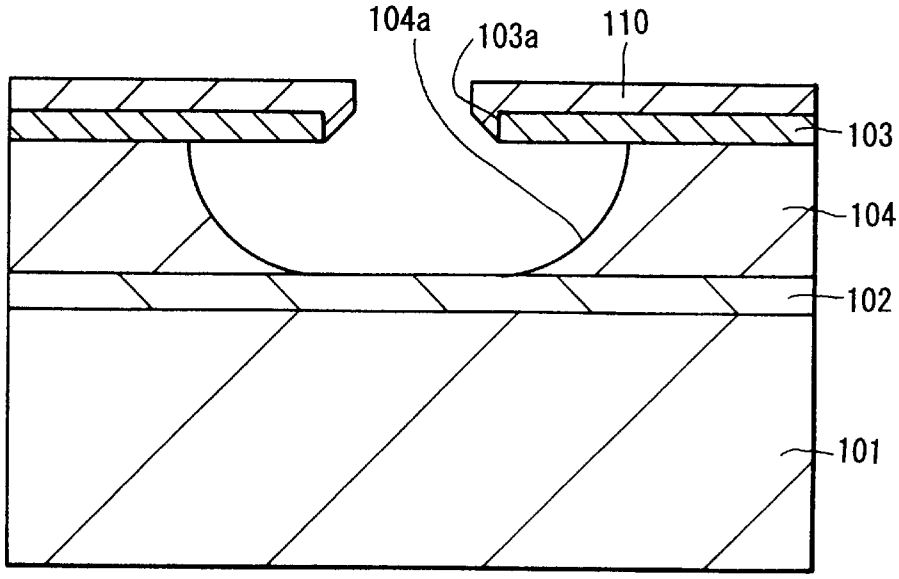
FIG. 10 is a cross-sectional view for explaining the conventional manufacturing method of a field emission type emitter.
Figure 11:
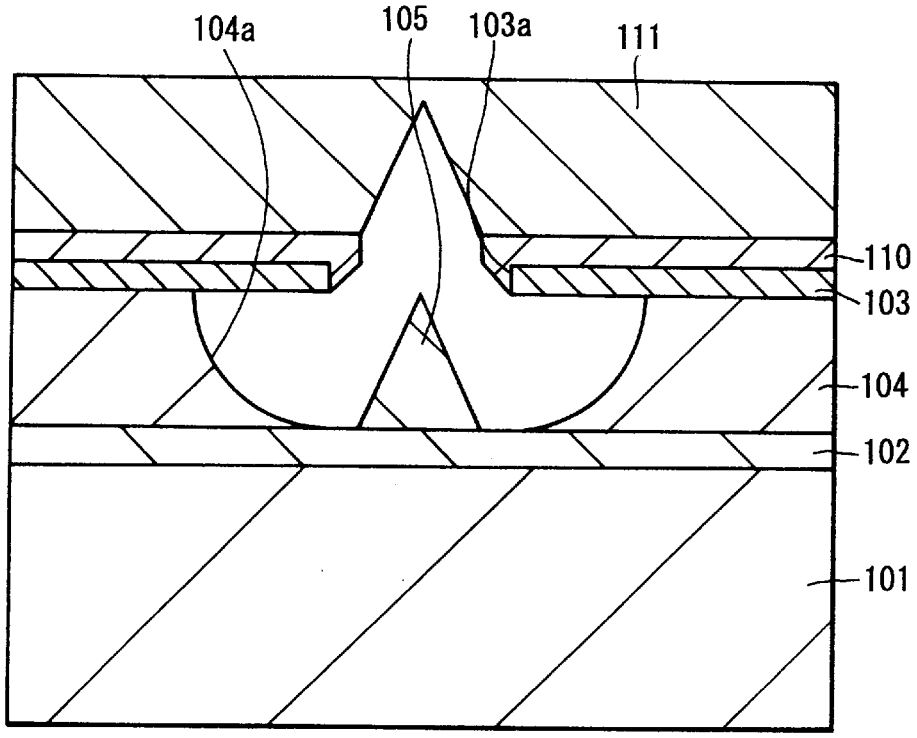
FIG. 11 is a cross-sectional view for explaining the conventional manufacturing method of a field emission type emitter.
Figure 12:
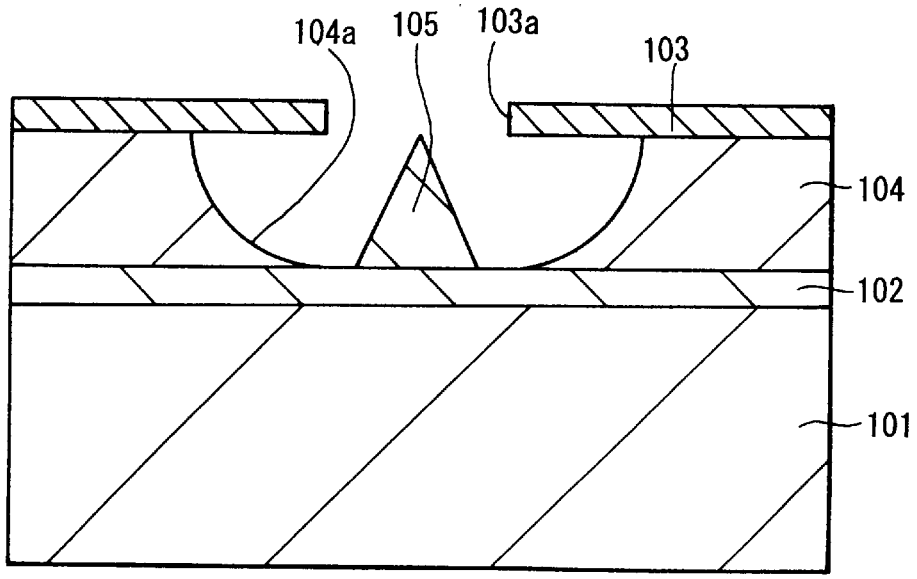
FIG. 12 is a cross-sectional view for explaining the conventional manufacturing method of a field emission type emitter.
Figure 13:
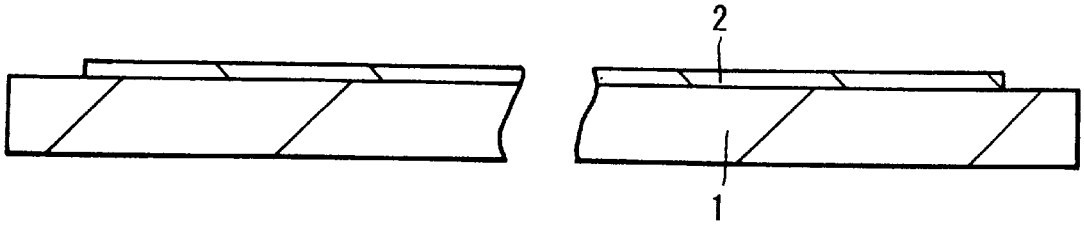
FIG. 13 is a cross-sectional view for explaining a manufacturing method of a field emission type emitter according to a first embodiment of the invention.
Figure 14:
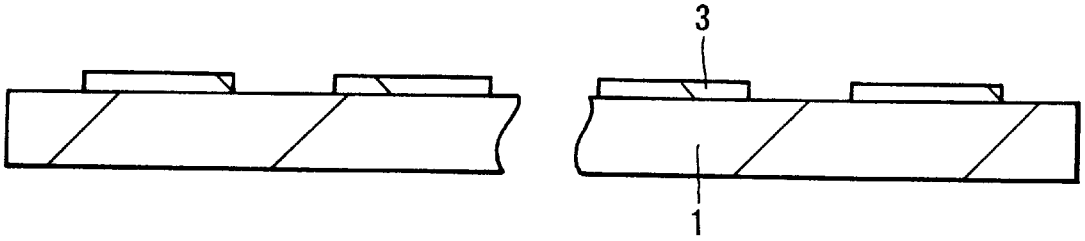
FIG. 14 is a cross-sectional view for explaining the manufacturing method of a field emission type emitter according to the first embodiment of the invention.

In the first embodiment, as shown in FIG. 13, a Ni film 2 with the thickness of 100 nm, for example, to be shaped as cathode electrode is stacked on a rear glass panel 1 by sputtering, for example. Next formed on the Ni film 2 is a resist pattern in form of parallel strips (not shown) by photolithography. then, the Ni film 2 is etched using the resist pattern as a mask to make parallel strip-shaped cathode electrodes 3. After that, the resist pattern is removed.

Figure 15:
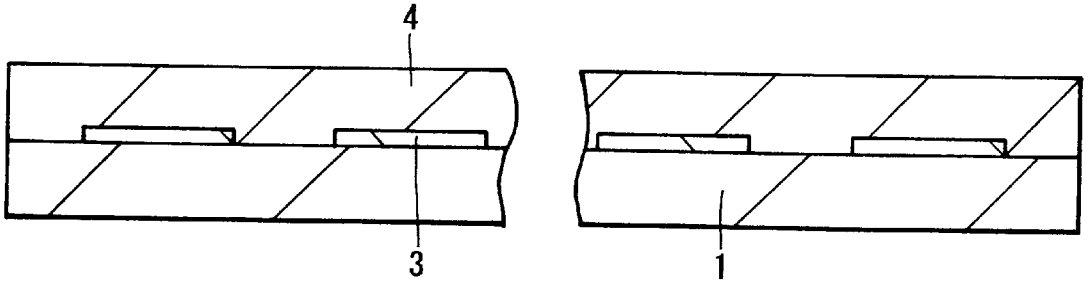
FIG. 15 is a cross-sectional view for explaining the manufacturing method of a field emission type emitter according to the first embodiment of the invention.
Figure 16:
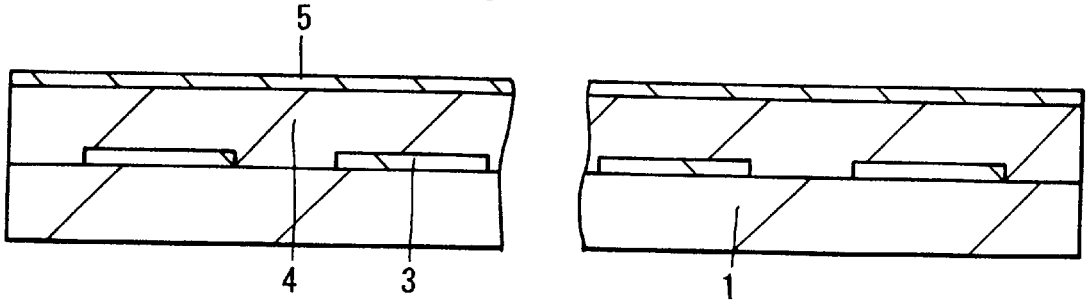
FIG. 16 is a cross-sectional view for explaining the manufacturing method of a field emission type emitter according to the first embodiment of the invention.

Next, as shown in FIG. 15, an insulating film 4 made of, for example, $SiO_2$, which may be 1 $\mu$m thick, is formed on the entire surface by CVD, for example, to cover the cathode electrode 3. Next formed on the insulating film 4 is a Mo film, 200 nm thick, for example, by sputtering, for example, to be shaped as gate electrodes. After that, a resist pattern in form of parallel strips (not shown) is formed on the Mo film by photolithography. The extending direction of the strip-shaped resist pattern (not shown) is perpendicular to the extending direction of the strip-shaped cathode electrodes 3. Using the resist pattern as a mask, the Mo film is etched by dry etching to form strip-shaped gate electrodes 5 extending across the cathode electrodes 3 as shown in FIG. 16. Then, the resist pattern is removed.

Figure 17:
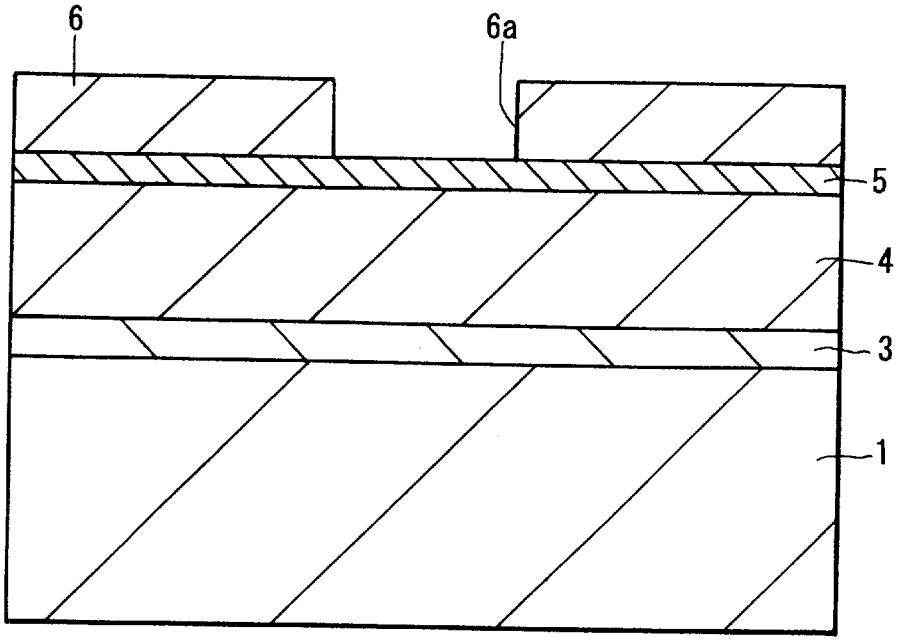
FIG. 17 is a cross-sectional view for explaining the manufacturing method of a field emission type emitter according to the first embodiment of the invention.

Next, as shown in FIG. 17, a resist pattern 6, which may be 1 $\mu$m thick, is formed by photolithography. The resist pattern 6 has formed apertures 6*a* at crossing points of the cathode electrodes 3 and the gate electrodes 5. These apertures 6*a* have a diameter of hundreds of nm to some $\mu$, for example, 1 $\mu$m, and are positioned at intersections of a virtual grating of some $\mu$m to tens of $\mu$m intervals, for example, 10$\mu$ intervals, on each intersection of the cathode electrodes 3 and the gate electrodes 5.

Figure 18:
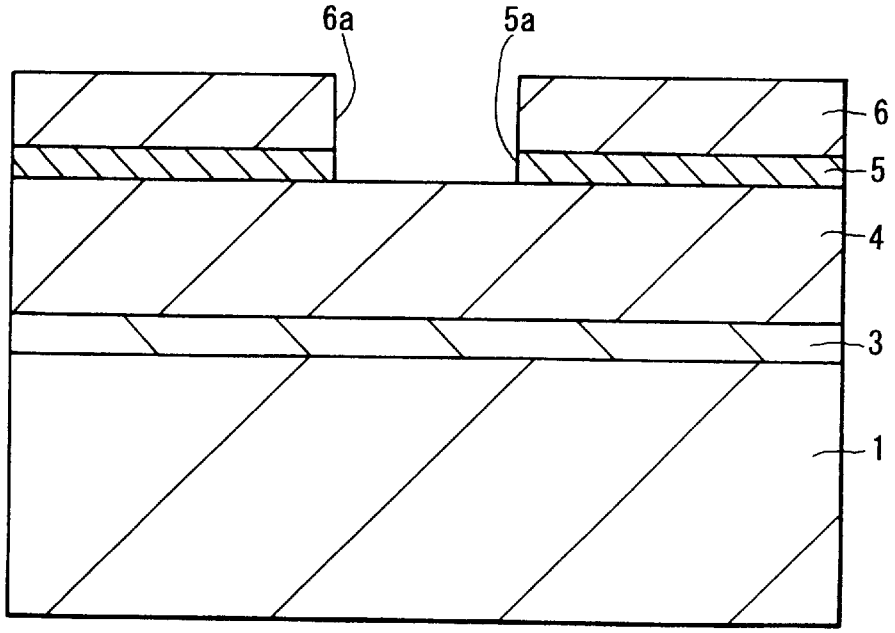
FIG. 18 is a cross-sectional view for explaining the manufacturing method of a field emission type emitter according to the first embodiment of the invention.

Using the resist pattern 6 as a mask, the gate electrodes 5 are etched, for example, by dry etching to make holes 5*a* as shown in FIG. 18.

Thousands holes 5*a*, for example, are made at each intersection of the cathode electrodes 3 and the gate electrodes 5.

Figure 19:
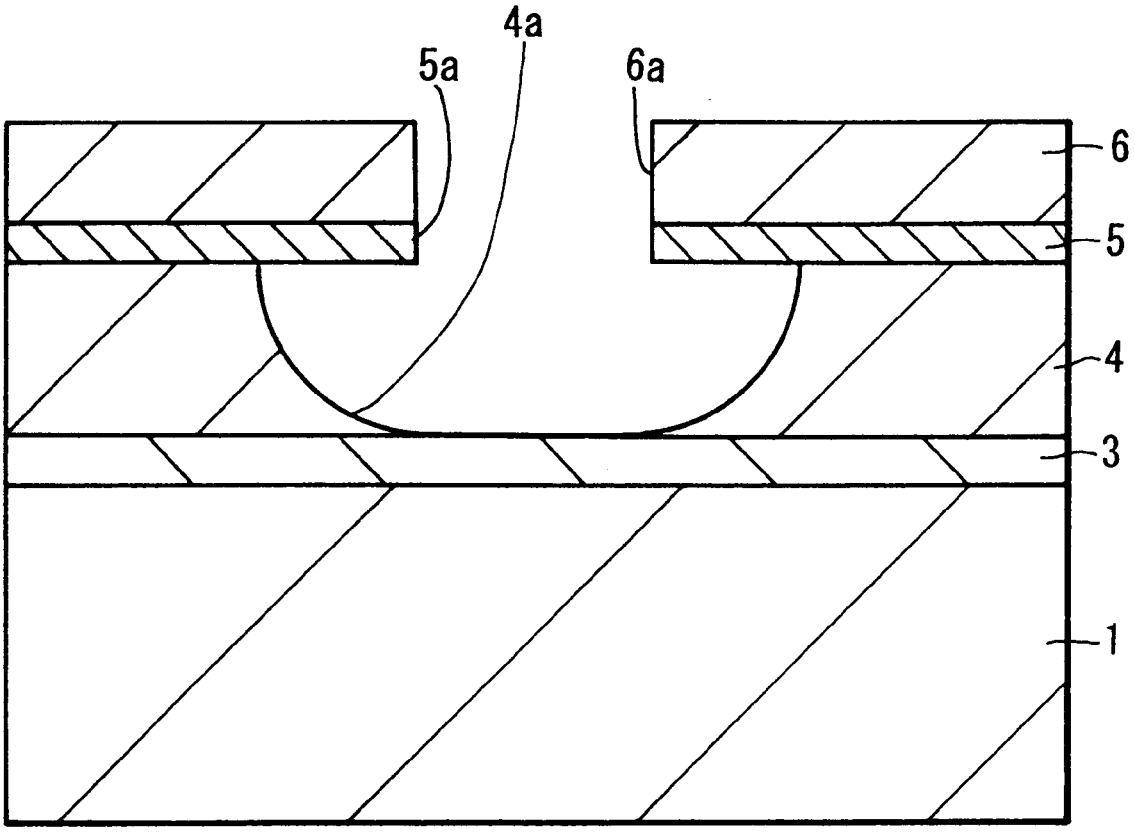
FIG. 19 is a cross-sectional view for explaining the manufacturing method of a field emission type emitter according to the first embodiment of the invention.

Next using the resist pattern 6 and the gate electrodes 5 as a mask, the insulating film 4 is etched until exposing the upper surface of the cathode electrodes 3 by wet etching using an etchant prepared by mixing, for example, hydrofluoric acid and ammonium fluoride. As a result, cavities 4*a* are made in the insulating film 4 as shown in FIG. 19.

Figure 20:
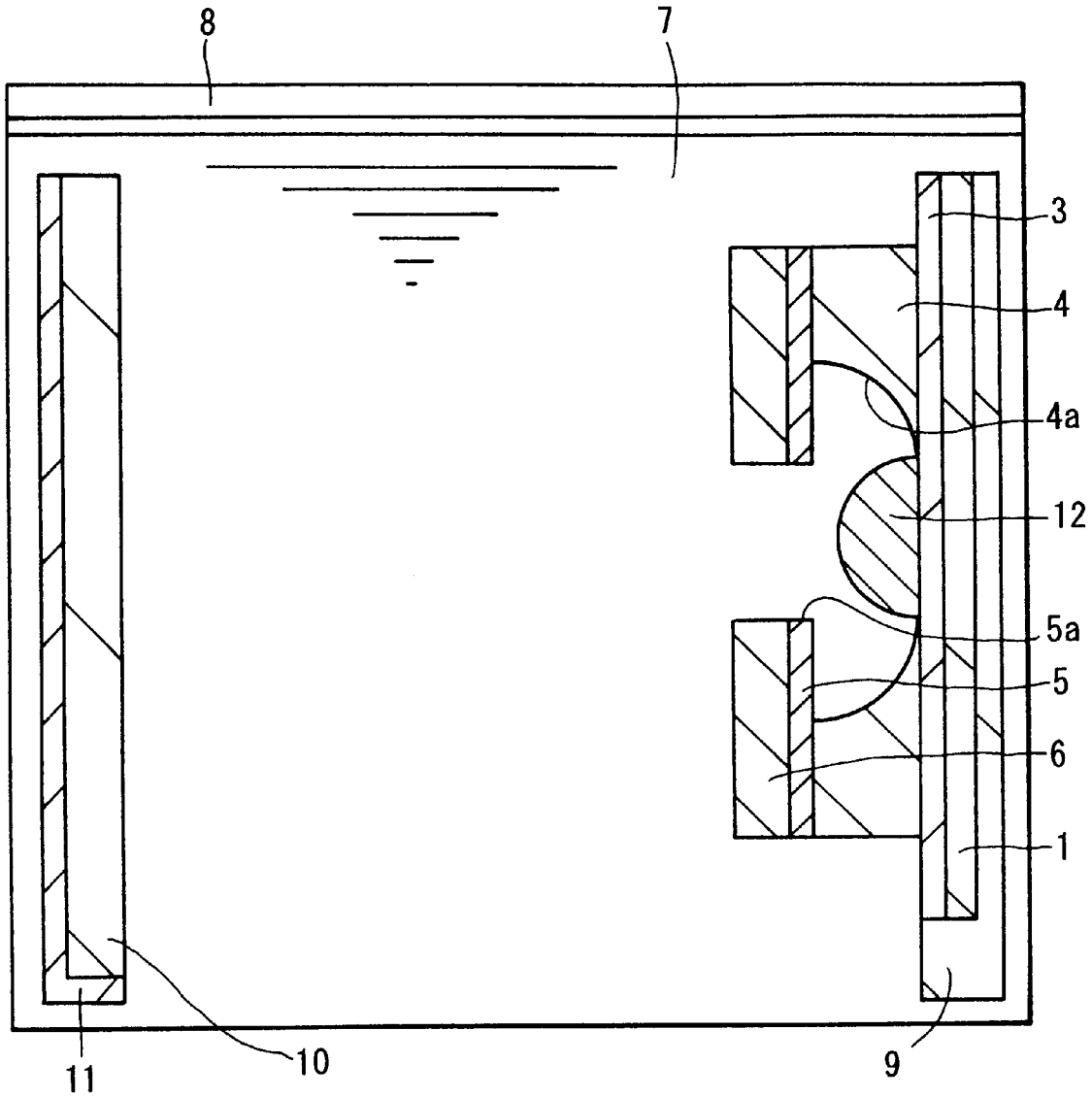
FIG. 20 is a cross-sectional view for explaining the manufacturing method of a field emission type emitter according to the first embodiment of the invention.

Next, as shown in FIG. 20, the rear glass panel 1 is fixed to a cathode holder 9 on one of inner wall surfaces of a electrolytic cell 8 filled with an electrolyte 7, electrically connecting the gate electrodes 5 to a electrolysis control electrode of a power source (not shown) and electrically connecting the cathode electrodes 3 to the minus terminal of the power source. An anode 10 in form of a Ni plate, for example, is fixed to an anode holder 11 on the opposite inner wall surface of the electrolytic cell 8, and electrically connected to the plus terminal of the power source.

Composition of the electrolyte 7 may be, for example, 1 part of nickel sulfominate ($Ni(SO_3(NH)_2)$ ), 0.05 to 0.1 part of nickel chloride ($NiCl_2$), 0.1 to 0.15 parts of phosphoric acid ($H_3(PO)_4$) and 4 parts of pure water ($H_2O$).

Then, the anode 10 and the cathode electrodes 3 forming the cathode are connected to predetermined potentials, respectively, and the gate electrodes 5 are connected to an intermediate potential between those of the anode 10 and the cathode electrodes 3. Thus, a current is supplied between the anode 10 and the cathode electrodes 3 forming the cathode to electroplate the product. As a result, Ni is deposited on the cathode electrodes 3 to form cathodes 12 inside the cavities 4*a*. The current may be supplied by any of the d.c. current process, pulse constant current process and constant potential process.

Figure 21:
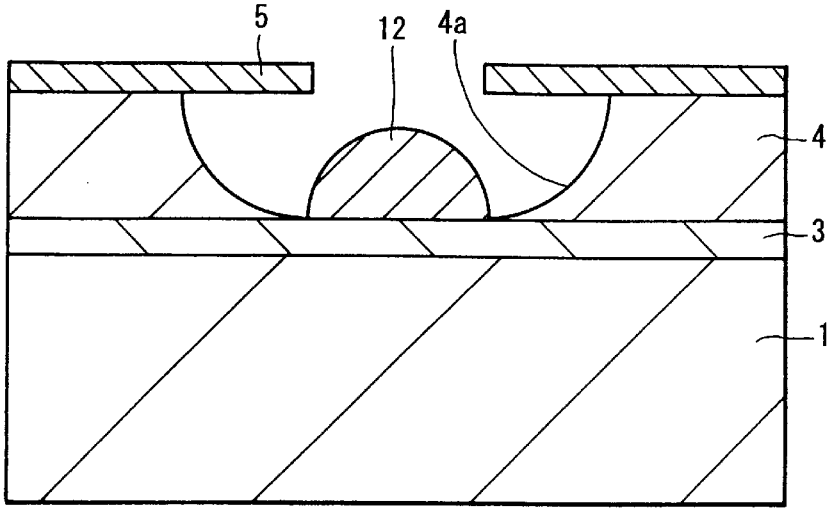
FIG. 21 is a cross-sectional view for explaining the manufacturing method of a field emission type emitter according to the first embodiment of the invention.

The rear glass panel 1 is next removed from the electrolytic cell 8 and rinsed, and the resist pattern 6 is removed thereafter. After that, the field emission type emitter as shown in FIG. 21 is obtained.

As explained above, according to the first embodiment, cathodes 12 are formed by electrochemically depositing Ni on to cathode electrodes 3 inside cavities 4*a* in the electrolyte 7 containing a Ni salt, the amount of the metal used for making cathodes 12 can be minimized, and the manufacturing cost of field emission type emitter can be reduced. Moreover, since cathodes 12 are formed by electrochemically depositing Ni on the cathode electrodes 3 made of the same material, Ni, the metal crystal along the interface between the cathode electrodes 3 and the cathodes 12 match with each other. Therefore, the adhesivity of the cathodes 12 to the cathode electrodes 3 is improved to exhibit an excellent mechanical strength, and the stability of the cathodes 12 is improved.

By using the field emission type emitter, thus made, a high quality, high resolution and large scaling of flat displays can be attained.

Next explained is a method for manufacturing a field emission type emitter according to the second embodiment of the invention.

In the second embodiment, the cathode electrodes 3 and the anodes 10 are made of an alloy based on Ni and containing Mo. Composition of the electrolyte 7 is, for example, 1 part of nickel sulfate ($NiSO_4.7H_2O$), 0.025 to 0.25 parts of natrium ammonium molybdate ($Na_2(NH_4)_2MoO_4.2H_2O$), 4 parts of natrium phosphorate ($Na_2P_2O_7$), and 20 parts of $H_2O$, and the cathodes are formed while making an alloy or eutectic crystal by incorporating Mo into deposited Ni. In the other respects, the second embodiment is the same as the first embodiment.

In the second embodiment, composition of the alloy forming the cathodes 12 can be controlled by adjusting the ratio of Mo in the electrolyte 7.

According to the second embodiment, the same effects as those of the first embodiment can be obtained. Additionally, since the cathode electrodes 3 and the cathodes 12 are made of an alloy of Ni and Mo, thermal stability and long-term stability of the cathodes 12 are ensured.

Next explained is a method for manufacturing a field emission type emitter according to the third embodiment of the invention.

In the third embodiment, the cathode electrodes 3 and the anodes 10 are made of an alloy based on Ni and containing W. Composition of the electrolyte 7 is one part of $NiSO_4.7H_2O$, 2.5 parts of natrium tungstate ($Na_2WO_2.2H_2O$), and 3 parts of citric acid, and the cathodes 12 are made while making an alloy by incorporating W into deposited Ni. In the other respects the third embodiment is the same as the first embodiment.

In the third embodiment, composition of the alloy forming the cathodes 12 can be controlled by adjusting the ratio of W in the electrolyte 7.

According to the third embodiment, the same effects as those of the second embodiment can be obtained.

Next explained is a method for manufacturing a field emission type emitter according to the fourth embodiment of the invention.

The fourth embodiment uses an electrolyte adding to the electrolyte 7 used in the second embodiment a salt of an alkaline earth metals having a low work function, such as, for example, 0.025 to 0.25 parts of ballium sulfate ($BaSO_4$). Then, Ni, Mo and Ba are deposited as an alloy or eutectic crystal on the cathode electrodes 3 inside the cavities 4*a*, in the electrolytic cell 8 filled with the electrolyte 7 as shown in FIG. 20, to make the cathodes 12. Then, after removing the rear glass panel 1 and from the electrolytic cell 8 and rinsing it and after removing the resist patter 6, the product is heated to selectively oxidize the surface of the cathodes 12 made of an ally of Ni, Mo and Ba. In the other respect, the fourth embodiment is the same as the second embodiment.

According to the fourth embodiment, since the cathodes 12 are made by depositing Ni, Mo and Ba having a low work function that Ni and Mo to make an alloy, and the surface of the cathodes 12 is selectively oxidized, an additional effect, namely, better electron emission characteristics of the cathodes 12, can be obtained in addition to the same effect as those of the first embodiment.

Next explained is a method for manufacturing a field emission type emitter according to the fifth embodiment of the invention.

Figure 22:
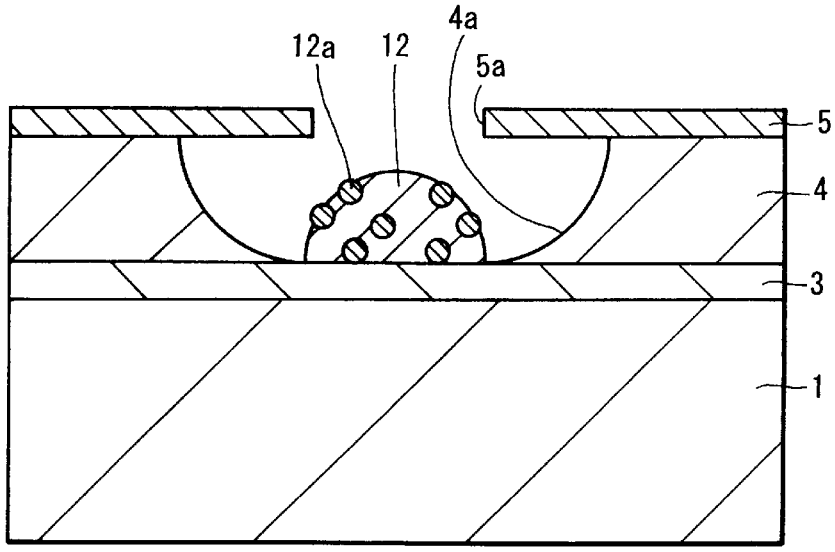
FIG. 22 is a cross-sectional view for explaining a manufacturing method of a field emission type emitter according to a fifth embodiment of the invention.
Figure 23:
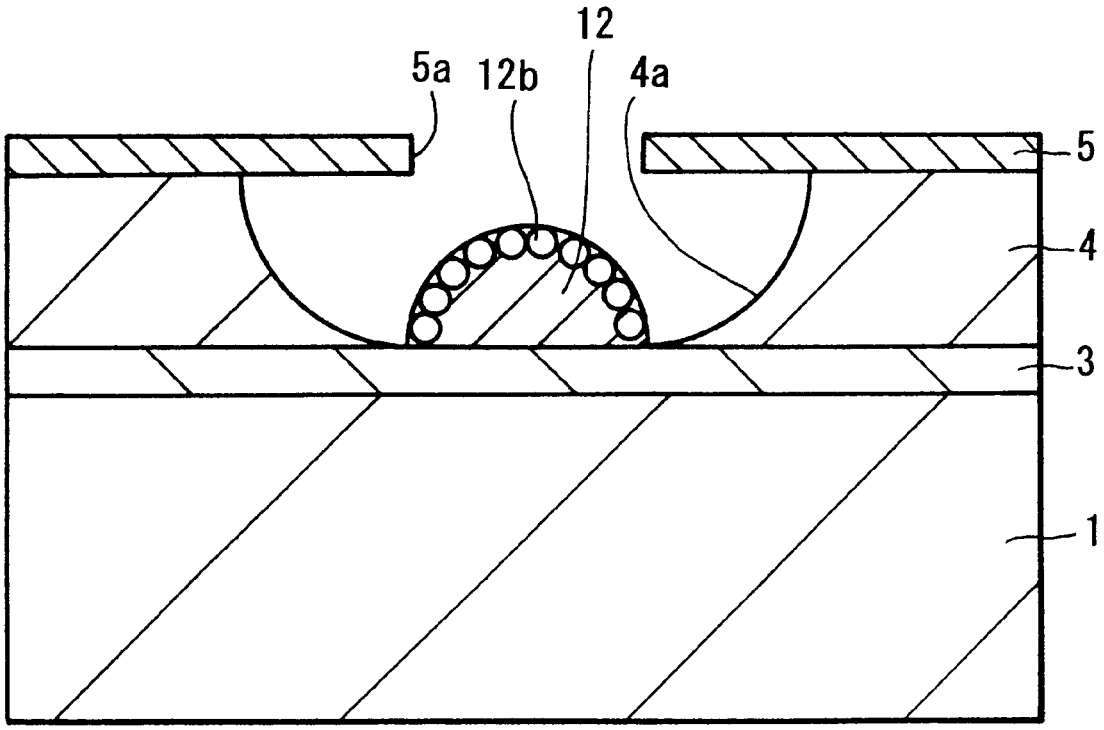
FIG. 23 is a cross-sectional view for explaining a manufacturing method of a field emission type emitter according to a sixth embodiment of the invention.

The fifth embodiment uses an electrolyte based on the electrolyte 7 used in the second embodiment and additionally containing fine particles of an oxide of an alkaline earth metals having a low work function than Ni or Mo, such as, for example, 0.025 to 0.25 parts of ballium oxide (BaO) fine particles. Using the electrolyte 7, while agitating and suspending the BaO fine particles so that they do not aggregate or precipitate, a predetermined current is supplied between the anodes 10 and the cathode electrodes 3 as cathodes. As a result, as shown in FIG. 22, a composite plating substance incorporating BaO fine particles 12*a* into the deposited alloy of Ni and Mo is formed to make the cathodes 12 containing the fine particles 12*a* along the surface. In the other respect, the fifth embodiment is the same as the second embodiment.

According to the fifth embodiment, since the cathodes 12 are made by incorporating fine particles 12*a* of a Ba oxide having a lower work function than the other metals into the deposited alloy of Ni and Mo, an additional effect, namely, better electron emission characteristics of the cathodes 12, can be obtained in addition to the same effects as those of the first embodiment.

Next explained is a method for manufacturing a field emission type emitter according to the sixth embodiment of the invention.

The sixth embodiment uses an electrolyte based on the electrolyte 7 used in the second embodiment and adding 0.025 to 0.25 parts of fine particles of an organic latex which is heat-decomposable or soluble to an organic solvent. Then, a predetermined current is supplied between the anodes 10 and the cathode electrodes 3 as cathodes while agitating and suspending the latex fine particles so that they do not aggregate or precipitate. As a result, the latex fine particles are incorporated into the deposited alloy of Ni and Mo on the cathode electrodes 3 inside the cavities 4*a*, and a composite plating substance is deposited. After that, the rear glass panel 1 is immersed into an organic solvent or heated to remove the latex so as to form the cathodes 12 with a number of minute bores along the surface. In the other respect, the sixth embodiment is the same as the second embodiment.

According to the sixth embodiment, since the cathodes 12 are formed to have a number of minute pores 12*b* along the surface, an additional effect, namely, excellent electron emission characteristics of the cathodes 12, can be obtained in addition to the same effects as those of the first embodiment.

Having described specific preferred embodiments of the present invention with reference to the accompanying drawings, it is to be understood that the invention is not limited to those precise embodiments, and that various changes and modifications may be effected therein by one skilled in the art without departing from the scope or the spirit of the invention as defined in the appended claims.

For example, numerical values suggested in the foregoing embodiments are only examples, and may be modified appropriately.

In the first to sixth embodiments, the gate electrodes 5 are connected to an intermediate potential between the potentials of the anodes 10 and the cathode electrodes 3 as cathodes; however, the gate electrodes 5 may be held electrically floating without setting them to any potential.

In the first embodiment, for example, the cathode electrodes 3 and the anodes 10 are made of Ni. However, where appropriate, they may be an alloy of Mo, Cr and Ni, alloy of Mo or alloy of Cr. In the second to sixth embodiments where the cathode electrodes and the anodes 10 are made of an alloy containing Ni as its major component, another alloy containing Mo or Cr as its major component may be used to make the cathode electrodes 3 and the anodes 10.

In the fourth embodiment, for example, Ba as an alkaline earth metals having a lower work function than the other metals is deposited in addition to Ni and Mo to make an alloy; however, Mg may be used as the alkaline earth metals to be deposited together with Ni and Mo. In this case, magnesium sulfate ($MgSO_4$) is used in lieu of $BaSO_4$ as the salt of the alkaline earth metals contained in the electrolyte 7.

As explained above, according to the invention, by making cathodes electrochemically in an electrolyte containing a salt of a metal, the cathodes can be made on cathode electrodes on a large-scaled substrate with a uniform thickness, using a minimum amount of metals, and this contributes to a reduction of the manufacturing cost of field emission type emitter.

What is claimed is:

1. A method for manufacturing a field emission type emitter including a cathode electrode formed on a substrate, an insulating film formed on said cathode electrode, a cavity formed in said insulating film, a cathode formed on said cathode electrode inside said cavity, and a gate electrode formed on said insulating film, comprising the step of:

electrochemically making said cathode in an electrolyte containing a salt of a metal, wherein said electrolyte additionally contains a salt of an alkaline earth metal having a lower work function than said metal.

2. The method for manufacturing a field emission type emitter according to claim 1 wherein said metal is the same as the metal forming said cathode electrode.

3. The method for manufacturing a field emission type emitter according to claim 1 wherein said metal is nickel, chrome, molybdenum or tungsten.

4. A method for manufacturing a field emission type emitter including a cathode electrode formed on a substrate, an insulating film formed on said cathode electrode, a cavity formed in said insulating film, a cathode formed on said cathode electrode inside said cavity, and a gate electrode formed on said insulating film, comprising the step of:

electrochemically making said cathode in an electrolyte containing a salt of a metal, wherein said electrolyte contains electrostatically charged organic or inorganic fine particles dispersed therein, so that said fine particles are incorporated into said metal deposited upon making said cathodes.

5. The method for manufacturing a field emission type emitter according to claim 4 wherein said fine particles are heat decomposable, and said cathodes are made to have pores along the surface thereof by heating said substrate to remove said fine particles due to thermal decomposition after said metal and said fine particles are deposited.

6. The method for manufacturing a field emission type emitter according to claim 4 wherein said fine particles are soluble to an organic solvent, and said cathodes are made to have pores along the surface thereof by removing said fine particles by means of said organic solvent after said metal and said fine particles are deposited.

7. The method for manufacturing a field emission type emitter according to claim 4 wherein said fine particles are made of an inorganic compound which is decomposable at a low temperature or sublimate.

8. The method for manufacturing a field emission type emitter according to claim 4 wherein said fine particles are made of an oxide of an alkaline earth metals.

9. The method for manufacturing a field emission type emitter according to claim 8 wherein said alkaline earth metals is ballium or magnesium.

10. The method for manufacturing a field emission type emitter according to claim 4 wherein said fine particles are made of hafnium carbonate, molybdenum carbonate, niobium carbonate, tantalum carbonate, titanium carbonate, tungsten carbonate, zirconium carbonate, or lanthanum hexaboride.

11. The method for manufacturing a field emission type emitter according to claim 4 wherein said fine particles are made of a latex.

* * * * *